US011702710B2

(12) United States Patent
Ajdari Rad

(10) Patent No.: US 11,702,710 B2
(45) Date of Patent: Jul. 18, 2023

(54) METHOD FOR REDUCING THE SUGAR LOSS IN THE REMOVAL OF A COAGULATE FROM PRE-LIMING JUICE AND FOR THICKENING THE COAGULATE, USE OF A DECANTER CENTRIFUGE, FRACTION CONTAINING PROTEIN, AND SUGAR BEET PRE-LIMING JUICE

(71) Applicant: SUDZUCKER AG, Mannheim (DE)

(72) Inventor: Mohsen Ajdari Rad, Worms (DE)

(73) Assignee: SUDZUCKER AG, Mannheim (DE)

( * ) Notice: Subject to any disclaimer, the term of this patent is extended or adjusted under 35 U.S.C. 154(b) by 631 days.

(21) Appl. No.: 16/643,200

(22) PCT Filed: Aug. 29, 2018

(86) PCT No.: PCT/EP2018/073190
§ 371 (c)(1),
(2) Date: Feb. 28, 2020

(87) PCT Pub. No.: WO2019/043035
PCT Pub. Date: Mar. 7, 2019

(65) Prior Publication Data

US 2020/0208227 A1 Jul. 2, 2020

(30) Foreign Application Priority Data

Aug. 31, 2017 (DE) ..... 10 2017 215 244.3

(51) Int. Cl.
*C13B 20/00* (2011.01)
*C13B 20/16* (2011.01)
*B04B 1/20* (2006.01)

(52) U.S. Cl.
CPC ..... *C13B 20/16* (2013.01); *B04B 1/20* (2013.01)

(58) Field of Classification Search
None
See application file for complete search history.

(56) References Cited

U.S. PATENT DOCUMENTS 4,381,849 A * 5/1983 Conant ..... B04B 1/2016 494/84
5,928,429 A * 7/1999 Duncan ..... C13B 20/02 127/48
2008/0017187 A1 1/2008 Deneus et al.
2008/0171843 A1 7/2008 Yen
2010/0136173 A1* 6/2010 Tang ..... A23J 1/14 426/63
2011/0250635 A1* 10/2011 Paz Briz ..... C12M 45/04 435/41
2013/0239635 A1* 9/2013 Ajdari Rad ..... C13B 20/00 44/589
2015/0231647 A1* 8/2015 Madsen ..... B04B 1/20 494/66

FOREIGN PATENT DOCUMENTS

CN 101791593 A 8/2010
DE 102006004103 A1 8/2007
DE 102010047995 A1 4/2012
EP 0574364 A1 12/1993
EP 1671704 A1 6/2006
EP 1682683 B1 1/2008
WO WO-2013010667 A1 * 1/2013 ..... B04B 1/2016

OTHER PUBLICATIONS

International Seach Report issued by the European Patent Office acting as the International Searching Authority in relation to International Application No. PCT/EP2018/073190, dated Nov. 27, 2018, 16 pages, with English Translation.
List of Refereces cited in DE 102017215244.3.
Database WPI Section Ch, Week 201063; Thomson Scientific, London, GB; Class J01, an 2010-K82776 XP0O2785765, "Horizontal Decant Centrifuge Separate Pectin Solid Liquid Bowl Length Specific MM Pitch Part Inclination Angle Degree Diamter Feed Inlet", Aug. 2010, pp. 1-9.
Japanese Office Action issued in connection with Japanese Patent Application No. 2020-512005, dated Feb. 22, 2022.
Mohsen Ajdari Rad, et al., "First Operating Experiance With the SZ Juice Cleaning Process at the Offstein Plant", Sugar Industry 136, No. 5, pp. 309-316, (2011).

* cited by examiner

*Primary Examiner* — Stefanie J Cohen
(74) *Attorney, Agent, or Firm* — Carter, DeLuca & Farrell LLP; George Likourezos; Bret P. Shapiro

(57) ABSTRACT

The present invention relates to the provision of a method for producing a clear sugar beet pre-limitation juice and a coagulate removed from the pre-liming juice, and to a pre-liming juice and protein-containing fraction that are provided by means of said method. A decanter centrifuge having an angle between the longitudinal axis of the bowl and the generatrix of the conical portion of 6 to 10° is used.

12 Claims, No Drawings

METHOD FOR REDUCING THE SUGAR LOSS IN THE REMOVAL OF A COAGULATE FROM PRE-LIMING JUICE AND FOR THICKENING THE COAGULATE, USE OF A DECANTER CENTRIFUGE, FRACTION CONTAINING PROTEIN, AND SUGAR BEET PRE-LIMING JUICE

CROSS-REFERENCE TO RELATED APPLICATIONS

This application is a national phase entry under 35 U.S.C. 371 of PCT International Application No. PCT/EP2018/073190 filed Aug. 29, 2018, which claims priority to German Patent Application No. 10 2017 215 244.3, filed Aug. 31, 2017, the disclosure of each of these applications is expressly incorporated herein by reference in their entirety.

DESCRIPTION

The present invention relates to the provision of a method for producing an optimal clear sugar beet pre-liming juice, wherein the clear sugar beet pre-liming juice has a considerably reduced solids content, and for the improved removal of the coagulate removed from the pre-liming juice.

Conventionally, sugar is obtained from beets by first cleaning the harvested beets, which frees these beets from a majority of the soil still adhering to the beets and leaves residue. After passing through a wash, the beets are grated into chips by cutting machines. The sugar is obtained from the chips by countercurrent extraction using hot, slightly acidified water. The filtration of the sugar beet raw juice and the pressability of the extracted chips are favored by the acidification of the extraction liquid. The sugar beet raw juice, which is obtained during the extraction, is then fed to an extract purification process. The extract purification is usually carried out with the aid of the so-called lime-carbonic acid extract purification in the form of a pre-liming step and a main liming step, as well as first and second carbonation steps, and the removal of the precipitate after the first and second carbonation steps. The extract purification has the task of substantially removing the non-sucrose substances contained in the sugar beet raw juice, in particular high molecular weight substances. The non-sucrose substances to be removed should not be decomposed to the extent possible, so that no additional low molecular weight substances enter the extract or sugar beet raw juice.

In the pre-liming step, the sugar beet raw juice is incrementally alkalized under gentle conditions by adding milk of lime. The pre-liming is carried out with the addition of defined amounts of calcium hydroxide (milk of lime). As a result of the alkalization of the sugar beet raw juice, the organic and inorganic acids present in the extract are neutralized and anions precipitate, which form insoluble or sparingly soluble salts with calcium. Thus, for example, phosphate, oxalate, citrate and sulfate are substantially separated. In addition, colloidally dissolved non-sucrose substances coagulate and are precipitated. The precipitation of individual ingredients, for example of anions such as oxalate, phosphate, citrate, sulfate or of colloids such as pectin and proteins, takes place within certain pH ranges. Within these pH ranges, compaction of the precipitate takes place at the same time. The addition of milk of lime during the pre-liming step also results in coagulation of proteins. Because of this protein content, the aforementioned separated non-sucrose substances are also referred to as protein-containing fractions of sugar beet raw juice.

The task of the subsequent main liming step by addition of milk of lime consists, in particular, of the chemical degradation of invert sugar and acid amides, which would otherwise take place during the juice thickening, with the formation of acids. The milk of lime added during the main liming step also plays an important role in the first and second carbonation steps. The reaction of calcium carbonate provides a strong absorbent for a series of soluble non-sucrose substances and also a suitable filtration aid. The milk of lime not consumed during the main liming process is converted into calcium carbonate in the two carbonation steps by the introduction of carbon dioxide as a carbonation gas. Carbonatation takes place in two stages. In the first carbonation stage, the precipitated and flocculated non-sucrose substances and a portion of the dyes present in the sugar beet raw juice are absorptively bound to the formed calcium carbonate. The so-called first carbonation juice obtained in the first carbonation stage is filtered or passed over decanting devices and thickened to give a carbonation juice concentrate. In the subsequent second carbonation stage, the so-called second carbonation juice is formed, which is likewise filtered and thickened. The calcium carbonate sludges (carbonation juice concentrate) concentrated in the first and second carbonation steps are usually combined and pressed. This results in so-called Carbokalk. This Carbokalk is a storable product with a dry substance content of more than 70%. The sugar beet pre-liming juice purified in the extract purification is further treated, and white refined sugar is obtained.

A considerable disadvantage of the conventional lime-carbonic acid extract purification is, in particular, that only a relatively low purification effect is achieved since only a maximum of 40% of all non-sucrose substances is removed from sugar beet raw juice. A further disadvantage is that the process requires very large amounts of milk of lime. However, the production of the milk of lime used in lime-carbonic acid extract purification processes and the disposal of the waste formed during the production of quicklime are relatively expensive. The carbon dioxide emissions from the lime kiln and juice clarification systems are also very high. Moreover, the Carbokalk resulting from the lime-carbon dioxide extract purification process, which consists of lime and separated juice impurities, can only be used as a fertilizer.

A method for the extract purification of sugar beet raw juice is known from EP 1 682 683 A, which comprises the following steps: pre-liming the sugar beet raw juice by adding milk of lime for the coagulation of non-sucrose solids, that is, the protein-containing fraction, adding at least one flocculation aid, removing the coagulate from the pre-liming juice using at least one first removal device to obtain a clear pre-liming juice, main liming the clear pre-liming juice obtained after removal of the coagulate by adding milk of lime, and carrying out a first and, if necessary, a second carbonation.

It is known from Fasol, Zuckerindustrie 135, 2010 (5, 228-294), to use decanter centrifuges having different discharge angles so as to thicken the obtained coagulates and to prepare them for the subsequent addition to pressed chips and for drying.

Disadvantages of these methods, however, include the comparatively high sugar loss, that is, the comparatively high proportion of sugar in removed coagulate, and an undesirably high solids content in the obtained clear pre-liming juice, both being phenomena that ultimately result from a process for separating clear pre-liming juice having a high sugar amount from the coagulate which still offers room for improvement. Moreover, it was found to be disadvantageous that even though, under certain conditions, the decanter centrifuges used according to Fasol were more stable than other configurations, continuous operation was not possible due to different viscosities of the solids fraction to be separated.

The present invention is therefore based on the technical problem of providing a method for producing a clear sugar beet pre-liming juice and a protein-containing fraction from sugar beet raw juice and products produced by this method, which overcome the afore-mentioned disadvantages, in particular of providing a method that reliably and accurately removes the coagulate from the prelimed raw sugar beet juice, leads to lower amounts of sugar being lost during the removal and thereby yields a particularly clear sugar beet pre-liming juice. Likewise, the method according to the invention is to be capable of a continuous mode of operation.

The present invention solves the underlying technical problem by providing the teaching of, in particular, the independent claims. The present invention solves, in particular, the underlying technical problem by providing a method for producing a clear sugar beet pre-liming juice and a protein-containing fraction, comprising the following method steps: a) providing a sugar beet raw juice; b) pre-liming the sugar beet raw juice provided in method step b) to obtain a pre-liming juice, forming a coagulate of non-sucrose substances that forms in the obtained pre-liming juice; c) setting a solids content of 15 to 25% by volume in the pre-liming juice (based on the total volume of the pre-liming juice provided in method step b); d) removing the coagulate from the pre-liming juice obtained in method step c) with a solids content of 15 to 25% by volume, using at least one decanter centrifuge, comprising a motor-driven, rotating centrifugal drum including a cylindrical section and a conical portion, wherein the angle between the longitudinal axis of the centrifugal bowl and the generatrix of the conical section is 6° to 10°, and an extruder screw mounted rotatably in the centrifugal bowl; and e) obtaining the clear sugar beet pre-liming juice and a protein-containing fraction.

The present invention also solves the underlying technical problem by providing a clear sugar beet pre-liming juice produced by the method according to the invention and a protein-containing fraction, which is preferably subsequently thickened, produced by the method according to the invention.

The invention therefore provides, in an advantageous and surprising manner, a method in which a sugar beet raw juice is provided in a first method step a), for example by means of extraction, in particular countercurrent extraction, from preferably sugar beets, in particular sugar beet chips, and the pre-liming of this sugar beet raw juice is carried out in a further method step b), whereby a pre-liming juice is created in which a coagulate of non-sucrose substances is formed. According to the invention, the solids content of the pre-liming juice is to be set in method step c) to 15 to 25% by volume (based on the total volume of the pre-liming juice used in method step b)).The invention provides, in a next method step d), that the coagulate from the pre-liming juice thus obtained is to be removed from a clear sugar beet pre-liming juice thus obtained, using at least one decanter centrifuge. The decanter centrifuge used according to the invention comprises a motor-driven, rotating centrifugal bowl, including at least one cylindrical portion and a conical portion, wherein the angle between the longitudinal axis of the centrifugal bowl and the generatrix of the conical portion is 6° to 10°, and an extruder screw mounted rotatably in the centrifugal bowl. A clear sugar beet pre-liming juice and a coagulate, in the form of a protein-containing fraction, are obtained in a subsequent method step e).

In the provided procedure, the invention provides for the use of at least one decanter centrifuge, which comprises at least one motor-driven, rotating centrifugal bowl including a cylindrical portion and a conical portion, wherein the angle between the longitudinal axis of the centrifugal bowl and the generatrix of the conical portion is 6° to 10°, and an extruder screw mounted rotatably in the centrifugal bowl, for removing a protein-containing fraction from a pre-liming juice having a solids content of 15 to 25% by volume (based on the total volume of the pre-liming juice used in method step b)). The clear sugar beet pre-liming juice thus obtained has a lower solids content, in particular compared to a procedure using a sugar beet raw juice having an identical composition and volume at a different discharge angle, in particular of 5° and/or a different solids content in the pre-liming juice, in particular 10% by volume. The protein-containing fraction thus obtained has an increased solids content, a smaller amount of sugar obtained per unit of time (corresponding to a reduced sugar loss in the clear sugar beet pre-liming juice) and an increased quantity of solids obtained per unit of time, in particular in comparison to a procedure using a sugar beet raw juice having an identical composition and volume at a different discharge angle, in particular of 5° and/or a different solids content in the pre-liming juice, in particular 10% by volume.

The procedure according to the invention surprisingly results in a considerably improved, that is, reduced, solids content compared to the prior art in the clear sugar beet pre-liming juice obtained after removal of the coagulate, that is, of the clarified product, as a result of the removal of the coagulate, while yielding an increased quantity of solids per unit of time and solids content, as well as a lower sugar amount of the protein-containing fraction.

In particular, without being bound to the theory, the specific combination of the discharge angle provided according to the invention, that is, the angle between the longitudinal axis of the centrifugal bowl and the generatrix of the conical portion, with the specific solids content used according to the invention in the pre-liming juice used for the removal of the coagulate appears to result in a markedly reduced sugar loss and a surprisingly low solids content in the clarified product in the method provided according to the invention. In particular, the combination according to the invention of the discharge angle and the specifically used solids content also surprisingly appears to result, at the same time, in increased solids discharge with a lower sugar amount, as well as an increased quantity of solids and solids content of the protein-containing fraction.

In a preferred embodiment, pre-liming is carried out in method step b) by adding milk of lime to the sugar beet raw juice, in particular up to an alkalinity of 0.1 to 0.3 g CaO/100 ml sugar beet raw juice. In particular, the pH is increased to 10 to 12, in particular 10.5 to 12, in particular 10.5 to 11.5, in particular 11.

According to the invention, it is provided in a preferred embodiment that at least one flocculation aid is added in a method step b1) to the pre-liming juice after the pre-liming step and prior to the removal of the formed coagulate, for example a polyanionic flocculant, such as a copolymer, such as an acrylamide/sodium acrylate copolymer, in particular having a molar mass of approximately 5 million to 22 million, preferably up to a concentration of 1 to 8 ppm.

In a particularly preferred embodiment, a solids content of preferably 17 to 23% by volume, in particular 18 to 22% by volume, in particular 20% by volume, is set in method step c).

In a particularly preferred embodiment, it is provided that the solids content of the pre-liming juice to be used in method step d) is set in method step c) by means of at least one separating device, in particular a decanter, for example a dynamic or static decanter, for example, a settling device.

In a particularly preferred embodiment, it is provided that the angle between the longitudinal axis of the centrifugal bowl and the generatrix of the conical portion of the centrifugal bowl of the at least one decanter centrifuge in method step d) and/or f), also referred to herein as the "discharge angle" or "discharge angle of the bowl", is 6 to 10°, preferably 8 to 10°, preferably 8°.

In a particularly preferred embodiment, it is provided that at least a portion of the clear sugar beet pre-liming juice obtained in method step e) is mixed with pre-liming juice from method step b). In method step c), the solids content is subsequently set, and the coagulate is subsequently removed in method step d).

In a particularly preferred embodiment of the present invention, it is provided that, in a method step f), the protein-containing fraction obtained in method step e) is thickened, that is, concentrated, in particular after prior dilution of the protein-containing fraction obtained in method step e) to a solids content of the protein-containing fraction of 15 to 25% by volume, in particular 20% by volume. In particular and preferably, method step f) is carried out using at least one further decanter centrifuge. In a specific embodiment, this further decanter centrifuge comprises a motor-driven, rotating centrifugal bowl including at least one cylindrical portion and at least one conical portion, wherein the angle between the longitudinal axis of the centrifugal bowl and the generatrix of the conical portion is 6 to 10°, preferably 8 to 10°, preferably 8°, and at least one extruder screw mounted rotatably in the centrifugal bowl is present. In a particularly preferred embodiment, this at least one decanter centrifuge is operated at no more than 50% of the maximum permissible torque for concentrating the protein-containing fraction obtained in method step e) by way of the aforementioned at least one further decanter centrifuge.

The procedure according to the invention provides the sequence of method steps a) to e), optionally also method step f), and in a particularly preferred embodiment, the method according to the invention includes method steps a) to e), in particular a) to f), that is, no further method steps take place between method steps a) to e), and in particular between the method steps a) to f). In a particularly preferred embodiment, a method according to the invention is provided in which method steps a) to e), and in particular a) to f), are carried out in precisely the stated sequence a), b), c), d), e) or a) b), c), d), e), f). According to the invention, it is further provided that the method steps are carried out simultaneously, overlapping in time or successively. In particular, method steps b) and c) and method steps d) and e) can be carried out together simultaneously or overlapping partially in time.

The present invention also provides a protein-containing fraction that can be produced, in particular is produced, according to one of the methods according to the invention.

The present invention also provides a clear sugar beet pre-liming juice that can be produced, in particular is produced, according to one of the methods according to the invention.

The present invention also relates to the use of a decanter centrifuge comprising a motor-driven, rotating centrifugal bowl including a cylindrical portion and a conical portion, wherein the angle between the longitudinal axis of the centrifugal bowl and the generatrix of the conical portion is 6° to 10°, and an extruder screw mounted rotatably in the centrifugal bowl to obtain a clear sugar beet pre-liming juice and a protein-containing fraction.

In the context of the present invention, the term "sugar beet raw juice" shall be understood to mean the juice, that is, the aqueous sugar-containing medium, which can be obtained, in particular is extracted, from sugar beets, for example from beet chips, by means of extraction or pressing processes, for example by thermal extraction methods such as countercurrent extraction at, for example, 65 to 75° C., in a so-called diffusion process, electroporation-assisted extraction methods or pressing processes. This sugar beet raw juice high in sugar, in addition to sugar (sucrose), also contains various organic and inorganic constituents of the beet, which are referred to as non-sucrose substances.

In the context of the present invention, a "clear sugar beet pre-liming juice" shall be understood to mean the juice, that is, the aqueous sugar-containing medium, which is obtained as a clarified product after removal of the protein-containing fraction. According to the invention, in a preferred embodiment this clarified product is characterized by a low solids content (in % by volume), that is, a solids content of less than or equal to 12% by volume. According to the invention, in a preferred embodiment a solids content of 1 to 12% by volume, in particular 1 to 10% by volume, in particular 1 to 6% by volume, in particular 2 to 12% by volume, in particular 2 to 10% by volume, in particular 2 to 6% by volume, in particular 4 to 12% by volume, in particular 4 tol 0% by volume, in particular 4 to 6% by volume in the clear sugar beet pre-liming juice is achieved.

In the context of the present invention, the "non-sucrose substances" present in the sugar beet raw juice shall be understood to mean high molecular weight substances such as proteins, polysaccharides and cell wall components, as well as low molecular weight compounds, such as inorganic or organic acids, amino acids and mineral substances. The cell wall components are, in particular, pectins, lignin, cellulose and hemicellulose. Similarly to the proteins, which, in particular, include nucleoproteins or glycoproteins, these substances are likewise present as hydrophilic macromolecules in colloidally dispersed form. The organic acids are, for example, lactates, citrates, pectic acid or oxalates. The inorganic acids are, in particular, sulfates or phosphates.

"Pre-liming" shall be understood to mean the addition of milk of lime to sugar beet raw juice, in particular up to an alkalinity of approximately 0.1 to 0.3 g CaO/100 ml sugar beet raw juice. In the pre-liming step, the sugar beet raw juice is alkalized under gentle conditions, the pH value of the sugar beet raw juice being raised from approximately 6 to approximately 11.5. The pre-liming step is used to flocculate non-sucrose substances, such as pectin and proteins, and to precipitate sparingly soluble calcium salts.

According to the invention, "milk of lime" shall, in particular, be understood to mean calcium hydroxide, which is formed with water during the highly exothermic reaction of quicklime (calcium oxide) and is used as a liming agent during pre-liming and main liming. The addition of milk of lime to the sugar beet raw juice in the pre-liming step causes the precipitation or coagulation of non-sucrose substances in the form of a coagulate.

In the context of the present invention, the non-sucrose substances of the sugar beet raw juice removed in the form of a coagulate in method step b) by pre-liming and, if necessary, the addition of a flocculation aid, are referred to as a "protein-containing fraction" or "colloidal fraction". This fraction is alkaline, due to its organic nature is perishable, and thixotropic. It behaves like a non-Newtonian fluid, and in particular, the viscosity decreases under shear stress, and the initial viscosity is restored after the stress.

According to the invention, a "coagulate" shall be understood to mean the aggregations of the non-sucrose substances present in the sugar beet raw juice due to a flocculation process. The coagulate comprises, in particular, the insoluble or sparingly soluble salts, which are formed by reactions of the anions of organic or inorganic acids with calcium, and the described high molecular weight sugar beet raw juice constituents, in particular of a hydrophilic nature, such as proteins, polysaccharides and cell wall components, which are normally colloidally dispersed in the sugar beet raw juice. In particular, anions such as oxalate, citrate, phosphate, sulfate and pectic acid are present in the coagulate, and thus in the protein-containing fraction, as are colloids, in particular pectin, proteins, cellulose and hemicellulose. The flocculation process is subdivided into a flocculation step in which the aggregation takes place by the absorption of bridging polymers, and a coagulation step in which aggregation takes place by degradation or reduction of repulsion forces. The flocculation rate depends on the temperature, the pH value and the manner of addition of the milk of lime. The precipitation of individual juice constituents, for example anions such as oxalate, phosphate, citrate and sulfate, as well as colloids such as pectin and protein, takes place in certain pH ranges, wherein densification of the precipitate takes place within these pH ranges. The pH value at which a maximum amount of colloids is flocculated and the precipitation of insoluble calcium salts is almost complete is referred to as the optimum flocculation point of the pre-liming process. If the precipitation takes place at the optimum flocculation point, uniform stable flocculation of colloidally disperse, high molecular weight juice components will occur.

The precipitation and coagulation of pectins and proteins require a certain temperature-dependent dwell time. According to the invention, it is provided that the pre-liming step can be carried out as a cold or as a warm pre-liming step. The cold pre-liming step is preferably carried out at a pre-liming temperature of approximately 38 to 40° C. According to the invention, however, there is also the option to carry out the addition of the milk of lime to the sugar beet raw juice as a warm pre-liming step at a temperature of the sugar beet raw juice of 55 to 75° C. The addition of milk of lime to the pre-liming step of the sugar beet raw juice is preferably effected according to the invention as a progressive pre-liming process. Progressive pre-liming shall be understood to mean a gradual increase in the alkalinity or the pH value of the sugar beet raw juice, preferably by slow feeding of the milk of lime, or by small intermittent single additions of milk of lime, wherein, in particular, the pH optimum is traversed slowly.

According to the invention, it is preferably provided that the progressive alkalization of the sugar beet raw juice can take place in a countercurrent process during the pre-liming process by means of an already alkalized sugar beet raw juice, for example by means of the carbonation juice concentrate from the carbonation stages. The progressive alkalization in a countercurrent process means that the added juice having higher alkalinity is mixed as quickly as possible with a juice having lower alkalinity, without different alkalinity gradients being able to develop within the mixing zone.

According to the invention, it is provided that the protein-containing fraction removed from the pre-liming juice in method step d) is obtained in method step e), preferably after collection. It is provided in a further preferred embodiment according to the invention that the protein-containing fraction obtained in method step e) is thickened in an optional method step f) by using a further decanter centrifuge according to the invention, preferably as used in method step d). According to the invention, this "thickening" shall be understood to mean the thickening of the protein-containing fraction to a preferred solids content of 35 to 50%, preferably 38 to 45%, preferably 45% (solids contents in the protein-containing fraction are based on the weight of the total composition in the present teaching, unless indicated otherwise).

In the context of the present invention, the "solids content" of the pre-liming juice shall be understood to mean the content, preferably in % by volume, of the pre-liming juice that is obtained after centrifugation, in particular at 4000 rpm and 10 minutes, and removal of the supernatant.

In the context of the present invention, the "solids content" of the protein-containing fraction shall be understood to mean the content, preferably in % by weight, of the protein-containing fraction that is obtained after the removal of water, for example by drying.

In the context of the present invention, the "solids quantity" of the protein-containing fraction shall be understood to mean the mass of the protein-containing fraction per unit of time, preferably in kilograms per hour, obtained in method step e) according to the invention. The solids quantity is calculated from the measured volume per unit of time of the protein-containing fraction after the density of the protein-containing fraction has been determined.

In the context of the present invention, the "solids content" in the clear sugar beet pre-liming juice shall be understood to mean the content of the clear sugar beet pre-liming juice that is obtained after centrifugation, in particular at 4000 rpm and 10 minutes, and removal of the supernatant.

In the context of the present invention, the "sugar amount" of the protein-containing fraction shall be understood to mean the mass of sugar that is present in the protein-containing fraction after removal of the coagulate from the pre-liming juice.

A "decanter", in particular a static or dynamic decanter, shall be understood to mean a device or an apparatus that is used to mechanically remove sedimented substances from a liquid according to the sedimentation principle with the aid of the gravity.

A decanter centrifuge according to the invention comprises a motor-driven, rotating centrifugal bowl including at least one cylindrical and at least one conical portion and at least one extruder screw mounted rotatably in the centrifugal bowl, as well as at least one inlet, at least one central outlet and at least one solids discharge.

It is provided in a particularly preferred embodiment that the torque during the operation of the centrifuge in method step d) and/or f) is no more than 50%, in particular no more than 40%, of the maximum permissible torque. It is provided in a further preferred embodiment that the torque during the operation of the centrifuge is from 10 to 50%, preferably from 20 to 50%, preferably from 30 to 50%, preferably from 10 to 40%, preferably from 20 to 40%, preferably from 30 to 40% of the maximum permissible torque.

In the context of the present invention, the "maximum permissible torque" shall be understood to mean the highest torque at which the centrifuge can be operated without causing permanent damage.

In the context of the present invention, "permanent damage" shall be understood to mean damage that significantly impairs the intended operation, and in particular causes the centrifuge to no longer be functional or to be reduced in the performance capability thereof to such an extent that it produces a product of insufficient quality in the context of the present invention, in particular a clear sugar beet pre-liming juice having, for example, a solids content in the clarified product of more than 15% by volume or a protein-containing fraction having a solids content of less than 35% by weight.

In the context of the present invention, a "flocculation aid" shall be understood to mean a substance that influences the zeta potential of particles in colloidal suspensions in such a way that they aggregate into flakes and can be removed from the system, for example, after sedimentation. Flocculation aids therefore have to overcome the electrostatic repulsion of the mostly negatively charged particles. According to the invention, the flocculation aid can also be a sedimentation accelerator.

In the context of the present invention, "flocculation aids" or "sedimentation accelerators" shall be understood to mean compounds that effect the aggregation of solid particles into larger units or flakes. As a result of the aggregation as flakes, the solids can settle much more quickly due to the larger mass thereof. At the same time, the pores between the individual particles are increased, so that water, which is present in the settled sludge, can be easily removed by filtration or centrifugation. The polyanionic flocculation aids preferred according to the invention have no coagulative effect whatsoever since they do not influence the dispersion of the particles in the liquid phase, but cause the aggregation of the particles by absorption-bridging polymers.

The acrylamide/sodium acrylate copolymers used in a preferred embodiment according to the invention as polyanionic flocculation aids are synthetic organic water-soluble polyelectrolytes having a relatively high molecular weight of approximately 5 million to approximately 22 million. These compounds are of an average to highly ionic nature. The products 2440 and 2540 (from Stockhausen) and NA 945 (from Clarflock) are particularly preferably used as flocculation aids.

Further advantageous configurations are apparent from the dependent claims.

The invention is described in more detail based on the following exemplary embodiments.

EXAMPLE 1

Raw juice from sugar beets is added and heated to 55° C. in a heatable container, which comprises a stirrer, an inlet for sugar beet raw juice and an outlet, and a pH electrode. Over a period of 20 min, milk of lime is gradually added to the raw juice, up to the pH of the optimum flocculation point of the pre-liming step (approx. 0.1 to 0.3 g CaO/100 ml of juice). To increase the settling rate, a polyanionic flocculation aid (Praestol 2540TR) is subsequently added. The pre-liming juice is drained, set to a solids content of 20% by volume using a static decanter, and fed to a decanter centrifuge, which has an angle between the longitudinal axis of the centrifugal bowl and the generatrix of the conical portion of 8° and is operated at 10 to 30% of the maximum permissible torque. The pre-liming juice (inflow) is fed to the decanter centrifuge at 3000 l/h. The protein-containing fraction is removed from the pre-liming juice and discharged from the decanter centrifuge via the solids discharge, and the clear sugar beet pre-liming juice is discharged from the central outlet of the decanter centrifuge. The solids content of the protein-containing fraction is 38 to 42% by weight, and the solids quantity is 192 kg/h of dry substance. The sugar amount of the protein-containing fraction is 15 kg/h, and the solids content in the clear sugar beet pre-liming juice is 4 to 6% by volume.

EXAMPLE 2

Comparison of different discharge angles between the longitudinal axis and generatrix of the conical portion of the centrifugal bowl Sugar beet raw juice is prelimed as in Example 1 and fed at 3000 L/h and a solids content of 20% by volume to various decanter centrifuges using different discharge angles of 5°, 8°, 10° and 15° between the longitudinal axis and the generatrix of the conical portion of the centrifugal bowl. The different decanter centrifuges are operated with different torques in each case to allow a removal of the coagulate. The protein-containing fractions separated by way of the different decanter centrifuges as well as clear sugar beet raw juices show differences in the solids content of the clear sugar beet pre-liming juice, as well as the sugar amount and the solids quantity and content of the protein-containing fraction (see Table 1). The use of a decanter centrifuge having an angle of 5° results in an increased amount of sugar as well as a low solids content (DS in % by weight) and a lower quantity of solids (kg/h) in the protein-containing fraction as well as in an increased solids content (in % by volume) in the clear sugar beet pre-liming juice. The use of a decanter centrifuge having an angle of 8° yields a particularly clear sugar beet pre-liming juice as well as a high solids content, a high quantity of solids and a lower sugar amount in the protein-containing fraction. The use of a decanter centrifuge having an angle of 10° likewise results in a comparable sugar amount and solids quantity as well as solids content of the protein-containing fraction. The decanter centrifuge having an angle of 15° is not able to separate the protein-containing fraction from the pre-liming juice, even when the maximum permissible torque is exceeded briefly.

TABLE 1

| Discharge angle | ° | 5 | 8 | 10 | 15 |
|---|---|---|---|---|---|
| Inlet (pre-liming juice) | l/h | 3000 | 3000 | 3000 | 3000 |
| Torque applied (% of maximum permissible torque) | % | very low | <40% | 40-80% | >100% |
| Solids content in pre-liming juice | % by volume | 20 | 20 | 20 | 20 |
| Clarified product (clear sugar beet pre-liming juice) | l/h | 2400 | 2600 | 2650 | 3000 |
| Protein-containing fraction | l/h | 600 | 400 | 350 | — |
| Protein-containing fraction, solids quantity | kg/h | 148 | 192 | 164 | — |
| Protein-containing fraction (DS), solids content | % by weight | 23 | 38-42 | 38-40 | — |
| Sugar amount of the protein-containing fraction | kg/h | 22 | 15 | 15 | — |
| Solids content in the clear sugar beet pre-liming juice | % by volume | 12-14 | 4-6 | 8-12 | — |

EXAMPLE 3

Comparison of the solids content in the inlet

A pre-liming juice prepared according to Example 1 is set to a solids content of 10, 20 and 30% by volume by means of a static decanter. These differently set pre-liming juices are each added to a decanter centrifuge using a discharge angle of 8°. The use of a pre-liming juice having different solids contents lead to different results:

The use of the pre-liming juice having a solids content of 10% by volume results in insufficient removal of the protein-containing fraction, and the use of the pre-liming juice having a solids content of 30% by volume results in an increased solids content in the clarified product (see Table 2). The use of a pre-liming juice having a solid content of 20% by volume results in a very clear sugar beet pre-liming juice and a high solids content in the protein-containing fraction.

TABLE 2

| | | | | |
|---|---|---|---|---|
| Discharge angle | ° | 8 | 8 | 8 |
| Inlet (pre-liming juice) | l/h | 3000 | 3000 | 3000 |
| Torque applied (% of maximum permissible torque) | % | <40% | <40% | 20-60% |
| Solids content in pre-liming juice | % by volume | 10 | 20 | 30 |
| Clarified product (clear sugar beet pre-liming juice) | l/h | 2780 | 2600 | 2600 |
| Protein-containing fraction | l/h | 220 | 400 | 400 |
| Protein-containing fraction, solids quantity | kg/h | 100 | 192 | 192 |
| Protein-containing fraction (DS), solids content | % by weight | 36-40 | 38-42 | 38-42 |
| Sugar amount of the protein-containing fraction | kg/h | 9 | 15 | 15 |
| Solids content in the clear sugar beet pre-liming juice | % by volume | 2-3 | 4-6 | 16-20 |

EXAMPLE 4

A pre-liming juice produced according to Example 1 having a solids content of 15% by volume is added to a decanter centrifuge having a discharge angle of 10° (operated as described in Example 1). The obtained clear sugar beet pre-liming juice is collected and treated further. The protein-containing fraction having a solids content of 36% by weight is collected, diluted to a solids content of 20% by volume and added to a further decanter centrifuge. This further decanter centrifuge has a discharge angle of 8° and is operated at a torque of no more than 50% of the maximum permissible torque. The protein-containing fraction is thickened to a solids content of 45% by weight by way of the further decanter centrifuge.

The invention claimed is:

1. A method for producing a clear sugar beet pre-liming juice and a protein-containing fraction from sugar beet raw juice, comprising the following method steps:

a) providing the sugar beet raw juice;

b) pre-liming the sugar beet raw juice provided in method step a) to obtain a pre-liming juice, forming a coagulate of non-sucrose solids forming in the obtained pre-liming juice;

c) setting a solids content of 15-25% by volume (based on the total volume of the pre-liming juice provided in method step b), in the pre-liming juice;

d) separating the coagulate from the pre-liming juice obtained in method step c) using at least one decanter centrifuge, comprising a motor-driven, rotating centrifugal bowl including a cylindrical portion and a conical portion, wherein the angle between the longitudinal axis of the centrifugal bowl and the generatrix of the conical portion is 6° to 10°, and an extruder screw mounted rotatably in the centrifugal bowl; and e) obtaining the clear sugar beet pre-liming juice and the removed coagulate in the form of a protein-containing fraction.

2. The method according to claim 1, wherein the solids content of the pre-liming juice is set in method step c) by means of at least one separating device.

3. The method according to claim 1, wherein, in a method step f), the protein-containing fraction obtained in method step e) is thickened using at least one further decanter centrifuge.

4. The method according to claim 1, wherein at least a portion of the clear sugar beet pre-liming juice obtained in method step e) is mixed in a further method step with pre-liming juice from method step b), a pre-liming juice mixed with clear sugar beet pre-liming juice is obtained, the solids content is set in method step c) and subsequently fed to a coagulate removal process in method step d).

5. The method according to claim 1, wherein the angle between the longitudinal axis of the centrifugal bowl and the generatrix of the conical portion is 8° to 10°.

6. The method according to claim 5, wherein the angle between the longitudinal axis of the centrifugal bowl and the generatrix of the conical portion of the at least one decanter centrifuge is exactly 8°.

7. The method according to claim 1, wherein the pre-liming juice used in method step d) has a solids content of 20% by volume.

8. The method according to claim 1, wherein the at least one decanter centrifuge used in method step d) and/or f) is operated at a torque of no more than 50% of the maximum permissible torque.

9. The method according to claim 3, wherein the at least one further decanter centrifuge used in method step f) is operated at a torque of no more than 50% of the maximum permissible torque.

10. The method according to claim 1, wherein the at least one decanter centrifuge used in method step d) is operated at a torque of no more than 40% of the maximum permissible torque.

11. The method according to claim 3, wherein the at least one further decanter centrifuge used in method step f) is operated at a torque of no more than 40% of the maximum permissible torque.

12. The method according to claim 1, wherein, following method step b), a flocculation is carried out in a method step b1), adding at least one flocculation aid.

* * * * *